United States Patent [19]

Sonomura

[11] 4,102,412

[45] Jul. 25, 1978

[54] APPARATUS AND METHOD FOR PLACING EXPLOSIVES IN SUBMERGED ROCK

[76] Inventor: Roy N. Sonomura, P.O. Box 1452, Hilo, Hi. 96720

[21] Appl. No.: 688,551

[22] Filed: May 17, 1976

[51] Int. Cl.[2] ..... E21B 7/12

[52] U.S. Cl. ..... 175/5; 86/20 C; 102/20; 166/63

[58] Field of Search ..... 175/5, 9, 10, 209, 211, 175/393; 166/63; 86/20 C; 102/20, 21, 23

[56] References Cited

U.S. PATENT DOCUMENTS

| | | | |
|---|---|---|---|
| 371,298 | 10/1887 | Bourne | 102/23 |
| 1,517,556 | 12/1924 | Grant | 175/10 |
| 1,645,989 | 10/1927 | Hansen | 175/10 |
| 1,697,649 | 1/1929 | Hansen | 175/10 |
| 1,778,320 | 10/1930 | Hansen | 175/9 |
| 2,614,804 | 10/1952 | Carlisle | 102/20 |
| 2,793,833 | 5/1957 | Daniel, Sr. | 175/393 |
| 2,883,154 | 4/1959 | Daniel, Sr. | 166/63 |

*Primary Examiner*—James A. Leppink
*Attorney, Agent, or Firm*—William B. Walter

[57] ABSTRACT

So that explosives can be placed in an underwater hole in rock efficiently, a rock drilling machine having a rock drill mounted for extension and retraction on a strut which can be forced against a surface to be drilled, has a short debris guard tube fixed to the strut so as to extend beyond the terminus of the strut so that the debris guard may be forced against and held against the surface of the rock to be drilled. In such a machine having a very long strut and drill rod for drilling holes in rock submerged at a depth of water over four feet, a drill guide tube fixed to the strut between the debris guard and the drill has a full length door. After the hole has been drilled to depth, the drill rod is retracted from the debris guard and deflected to one side (and out of the drill guide tube door of the long strut version) and a long explosives placement tube is inserted through the debris guard tube into the hole. The debris guard is then slipped off and freed from the placement tube by retracting the strut. The upper end of the placement tube is left above the water surface, marking the hole location and allowing later placement of explosives while drilling continues at other locations. To both speed up the placement of holes and to allow the drilling of holes at an angle to the vertical, the drilling machine strut of the preferred embodiment is attached to the bucket end of a backhoe.

6 Claims, 6 Drawing Figures

FIG. 3
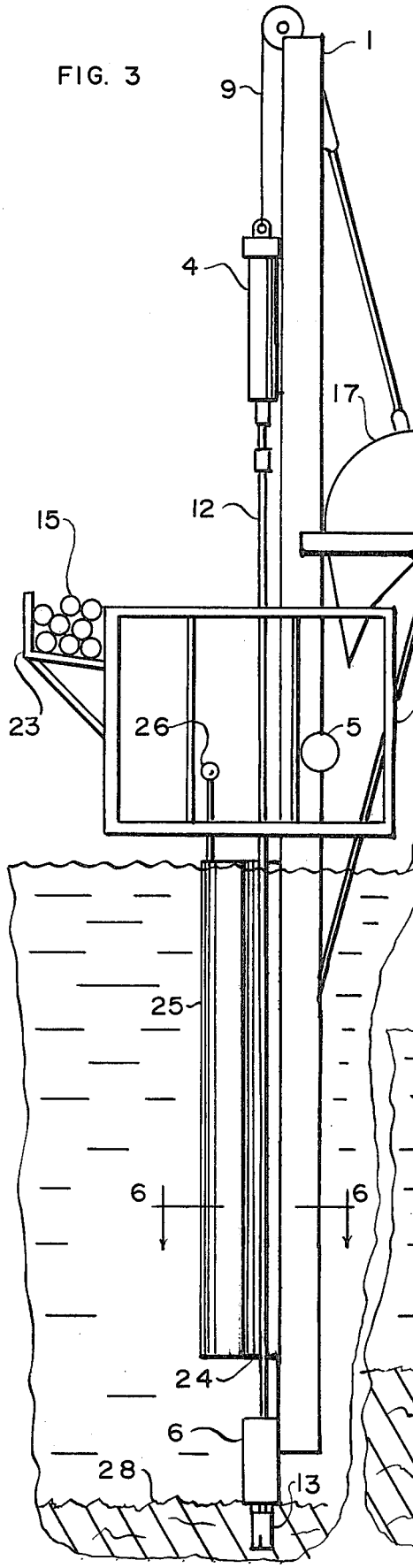
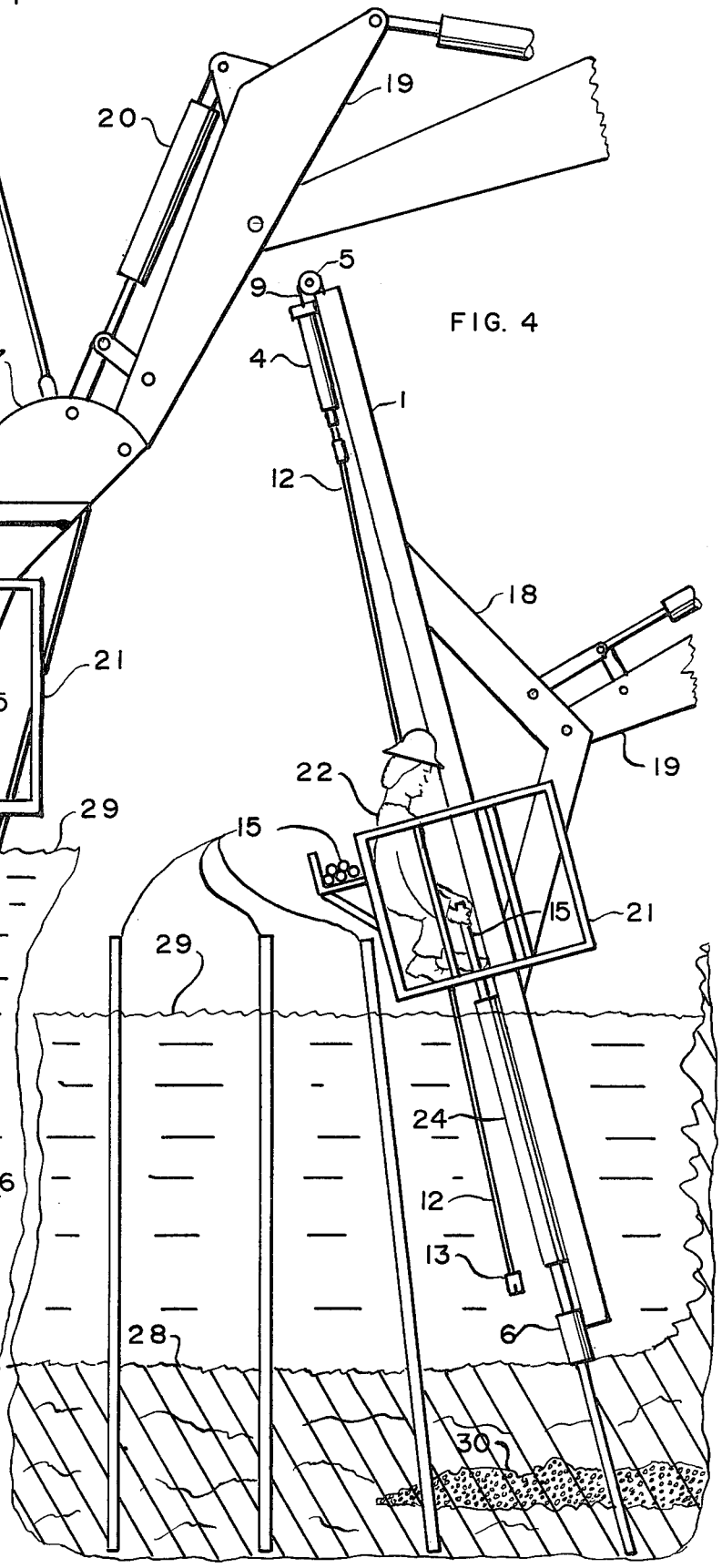
FIG. 4

APPARATUS AND METHOD FOR PLACING EXPLOSIVES IN SUBMERGED ROCK

BACKGROUND OF THE INVENTION

In a common form of modern rock-drilling apparatus, the drill motor is mounted for extension and retraction hydraulically along a strut the foot of which may be forced against the surface to be drilled. Such a strut is mounted on a tractor built for the purpose of moving the strut from place to place. Such drilling apparatus is used on building sites, road work, in mines and tunnels and can be moved reasonably quickly from point to point. The use of such a machine to drill holes in rock lined ditches is limited in depth of water because of the following: a. the arm is too short to operate from outside the ditch, b. moving the tractor in the ditch is limited by the depth at which the operator can wade alongside the machine, and c. the condition of the surface at the bottom of the ditch which the machine must traverse. When holes are drilled under water with such apparatus, nothing prevents the debris which has collected at the bottom of the ditch and the drill debris from falling back into the hole, and when the hole has been cleaned, filling of the hole with explosives is awkward because it is under water.

Means to limit the flow of debris into a hole drilled in submerged rock as found in the prior art include a short mud guard tube as in Hansen U.S. Pat. No. 1,645,989 which is lowered to the bottom by the submerged weight of the mud guard plus the drill motor, and a long telescopic sand guard in Hansen U.S. Pat. No. 1,697,649 lowered to the bottom by the submerged weight of the lower section of the sand guard.

The method of loading explosives into the hole drilled in submerged rock described in the prior art is to place the charge through the telescopic sand guard tube of Hansen U.S. Pat. No. 1,697,649 after raising the drill motor and removing the drill steels from the drill motor and sand guard. Bourne in U.S. Pat. No. 371,298 shows the use of a filling tube for placing explosives in a dry land hole so that in successive steps an enlarged cavity may be formed at the bottom of the hole to receive a large explosive charge, however, the use of such a filling tube as taught by this patent would require the services of a diver.

The method in which the drill may be moved from one hole location to another as taught in the prior art is limited to the use of a special boom mounted on anchored barges as in Hansen U.S. Pat. Nos. 1,697,649 and 1,778,320.

The placing of explosives in holes in submerged rock as accomplished prior to my invention is thus a long process because of the time taken to locate the hole, drill the hole (possibly changing drills in the process as in Hansen U.S. Pat. No. 1,645,989), keep the hole clean, charge the hole, and move the drill to the next location.

BRIEF SUMMARY OF THE INVENTION

The primary objects of this invention is to separate the drilling and loading operations of holes in rock submerged in water for subsequent blasting, in order to increase work and blasting efficiency.

Other objects of this invention are as follows:

1. to provide means to mark the location of the drilled hole above water.

2. to provide a very positive means to keep debris from all possible sources out of the drilled hole.

3. to protect the detonator wires leading from an explosive charged underwater hole.

4. to facilitate the rapid and accurate positioning of a rock drill.

5. to provide a means to positively gauge the depth of the hole and maintain the required depth for loading with explosives.

6. to provide means for the underwater drilling of holes in rock at various depths at an angle to the vertical.

This invention is a rock drilling apparatus for drilling holes in rock submerged in water having a short debris guard tube rigidly fastened to the strut along which the drill is extended and retracted so that the debris guard can be forced against and held against the surface to be drilled by the strut, and the method in which an explosives placement tube may be inserted into the hole and left behind the drilling operation so that after the drilling apparatus has been removed for subsequent drilling of other holes, a worker may charge the hole with explosives through the tube from above the water surface. The operations of drilling the hole and loading the explosives into the hole are separated so that the drill operator and apparatus are not delayed by the explosives placement operation and the explosives placement is not delayed by drilling.

BRIEF DESCRIPTION OF THE DRAWINGS

In the drawings,

FIG. 3 shows a preferred embodiment of the invention adapted to drill holes in rock submerged in deep water.

FIG. 4 shows the drilling apparatus of FIG. 3 in the operation of installing an explosives placement tube.

In FIGS. 1 through 5 the water and rock are shown in cross-section.

DETAILED DESCRIPTION OF THE INVENTION

Figure 1:
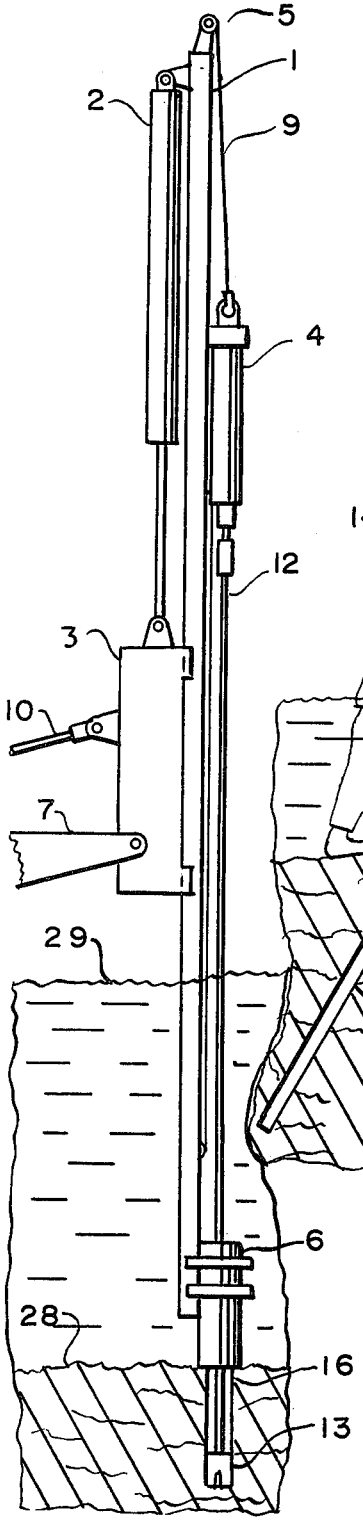
FIG. 1 shows the working end of a modern rock drilling apparatus according to this invention in which the rock drill is extended and retracted along a strut which can be forced against the surface to be drilled at any desired angle to that surface within limits.
Figure 2:
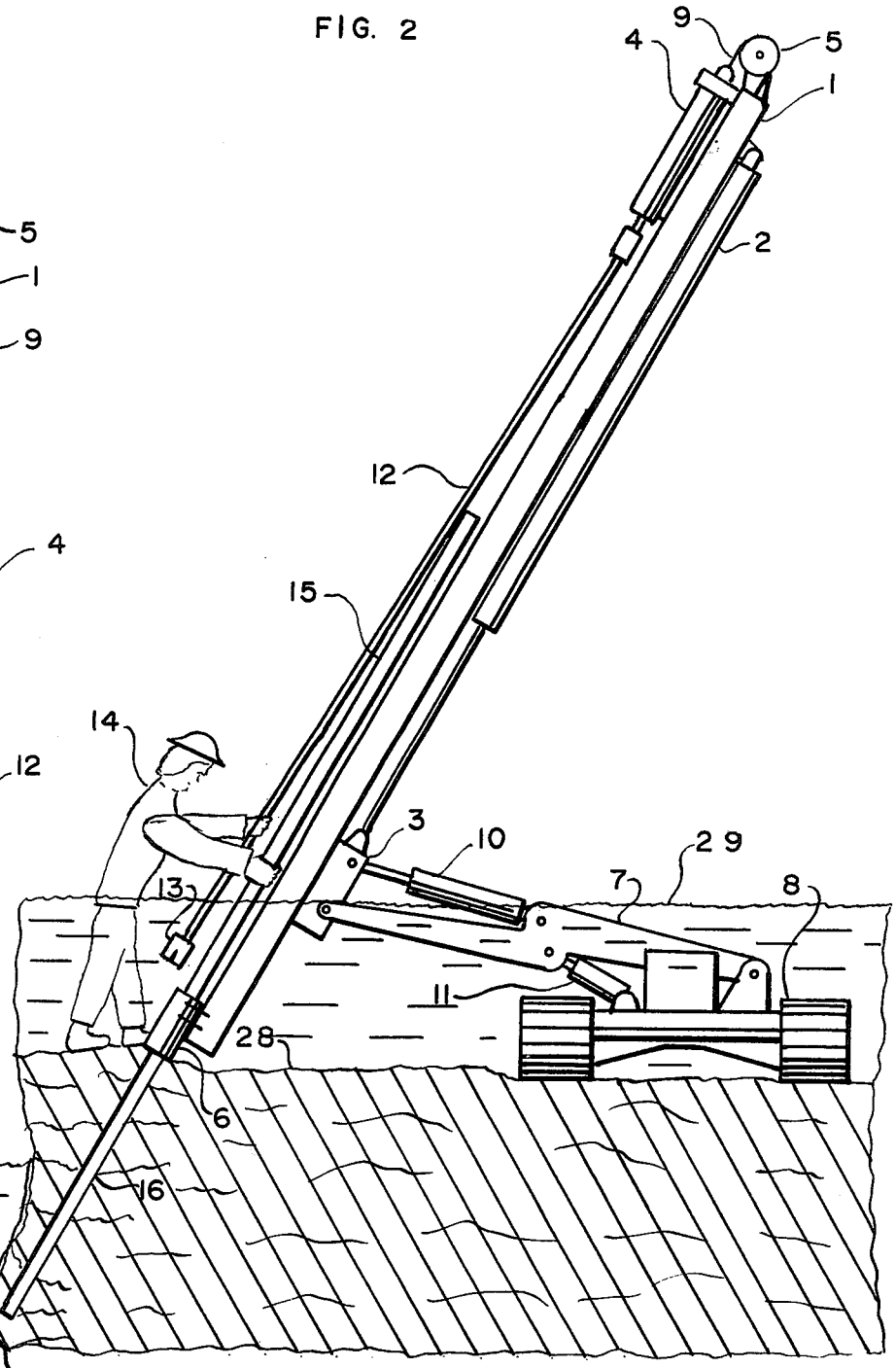
FIG. 2 shows the drilling apparatus of FIG. 1 in operation and submerged in shallow water.

A modern rock drill as used in mines, tunnels, roads and other construction work for drilling holes in rock for placement of explosives may be used for drilling holes in rock submerged in shallow water if modified according to my invention as shown in FIGS. 1 and 2. Although there are different makes and models of such apparatus, essentially it comprises a strut 1 mounted for extension and retraction by a strut actuator 2 on a base member 3 and a rock drill motor 4 which is mounted for extension and retraction along the strut 1 by a drill actuator motor 5 and continuous chain drive 9. A short debris guard tube 6 is strongly welded to the side of the strut 1 so as to extend beyond the bottom of the strut 1. The debris guard tube 6 can thus be forced against the surface 28 to be drilled by the strut actuator 2. The base member 3 is in turn mounted on an arm 7 pivotally supported on a tractor 8 which as shown in FIG. 2 may be operated on submerged rock and driven by pneumatic motors. The tractor 8 can be below the water line 29 as shown. Actuators 10 and 11 control the angle between the arm 7 and the base member 3 and between arm 7 and the tractor 8 respectively. In FIG. 1, the drill rod 12 and drill head 13 are seen coupled to the drill motor 4 and partially extended as the hole 16 is being drilled. In FIG. 2, the drill operator 14 is seen holding the drill rod 12 to one side while he places the explosives placement tube 15 in the hole 16 through the short debris guard tube 6. It will be noted that the debris guard tube 6 is sufficiently short that the drill head 13 will clear the top of the debris guard tube 6 when the drill motor 4 is fully retracted, the drill rod 12 bent to one side to allow entry of the explosives placement tube 15, and a long drill rod 12 may be used to drill a deep hole without removal of the drill rod 12. With this invention then, it is possible to drill a deep hole, remove the drill head 13 completely out of the hole 16 and debris guard tube 6, insert the explosives placement tube 15, gauge the depth of the hole 16 with the placement tube 15, and if the hole needs more cleaning to bring it down to required depth, remove the placement tube 15 and quickly re-insert the drill head 13 into the hole and clean it out to depth before the final placement of the explosives placement tube 15. This may need to be repeated several times.

Figures 5, 6:
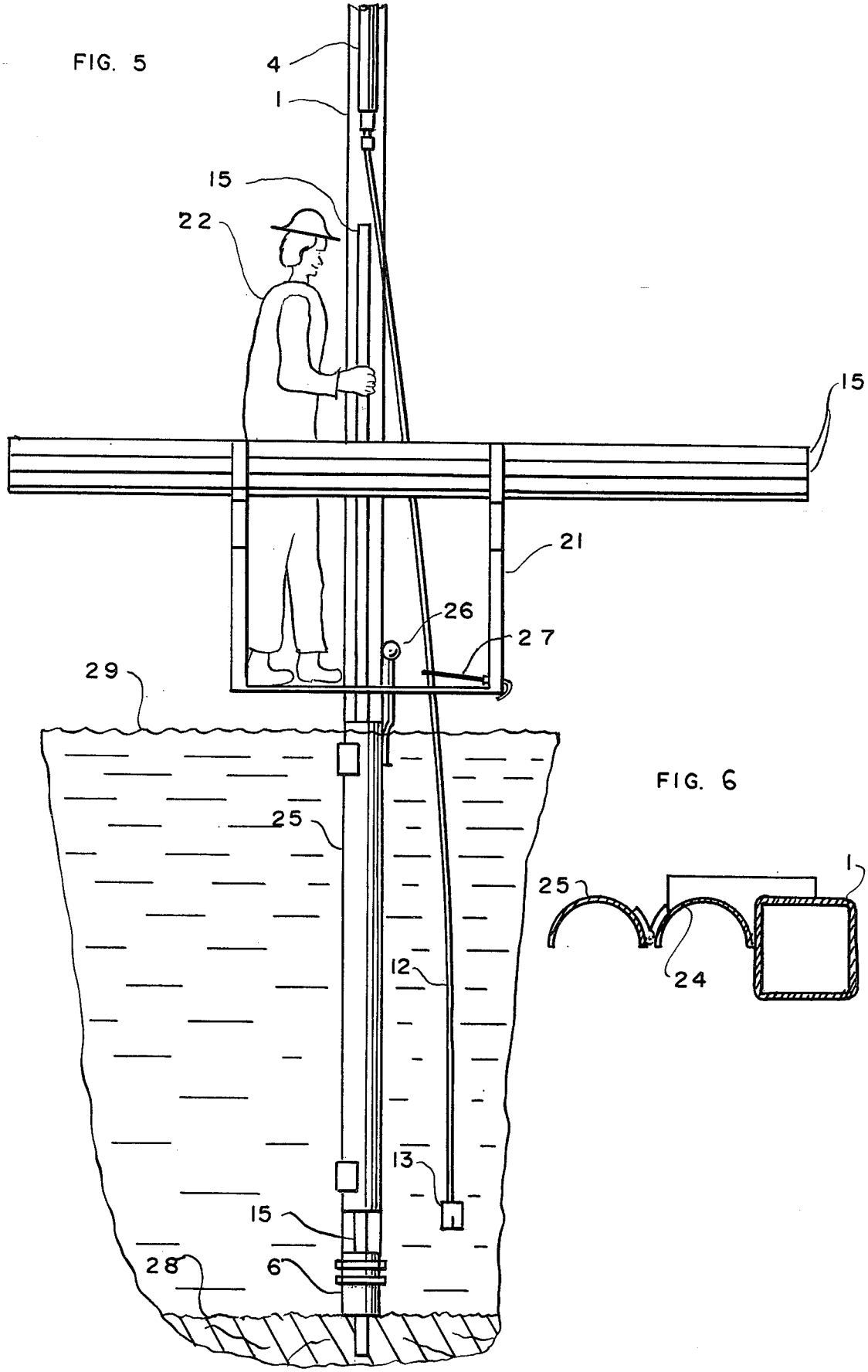
FIG. 5 is another view of the apparatus of FIG. 3 but at right angles to the views of FIGS. 3 and 4 so as to show the manner in which the drill rod may be deflected so as to introduce the explosives placement tube into the drilled hole.
FIG. 6 is a section on the line 6—6 of FIG. 3.

Whereas the drilling apparatus of FIGS. 1 and 2 may be satisfactorily used in water which is sufficiently shallow for the operator 14 to wade in, in which the water is clear enough so that the bottom may be seen, and where the bottom is smooth enough for safe manipulation of the tractor 8, there is a demonstrated need for this invention in deeper water and where the bottom 28 may be too rough for a tractor 8. Thus in the preferred embodiment of this invention as shown in FIGS. 3, 4 and 5, the strut 1 is much longer than that of FIGS. 1 and 2, and the strut 1 has been adapted to either be attached to the bucket 17 of a backhoe, or the strut 1 is attached to a base member 18 which in turn may be attached to the arm 19 and actuator 20 of a backhoe in place of the bucket 17. A control platform 21 supports the drill operator 22 above the water and a rack 23 for a supply of explosives placement tubes 15.

A drill guide tube 24 mounted on the strut 1 below the control platform 21 has a hinged door 25 which extends for the full length of the guide tube 24 as seen in FIG. 3. The hinged door 25 can be opened and closed by the drill operator 22 using the door handle 26 while standing on the control platform 21. The debris guard tube 6 is about one foot long (30.5 cm.) and is open at the top and the bottom. The inside diameter of the debris guard tube 6 and the drill guide tube 24 is large enough to readily accept the drill head 13, and when the hole has been completed and the drill head removed, to accept the explosives placement tube 15.

In the preferred embodiment of the invention as shown in FIGS. 3, 4 and 5, the drill guide tube 24 and debris guard tube 6 are spaced axially apart about 18 inches (46 cm.) to allow the debris which is pumped out of the hole 16 during drilling to flow away from the strut 1 and keep the drill guide tube 24 clear. As can be seen in the drawings, FIGS. 3, 4 and 5, the drill rod 12 in the preferred embodiment may very easily be over 20 feet (6.1 m.) long, and the drill guide tube, when closed, insures that as the drill is extended after being retracted out of the debris guard tube 6, the drill head 13 will enter the debris guard tube 6. A drill guide tube is not entirely necessary on a drilling machine of the type shown in FIGS. 1 and 2 since the drill rod 12 is much shorter, being about 15 feet (4.6 cm.) maximum, and the drill operator 14 standing near the debris guard tube 6 can direct the drill head 13 or explosives placement tube 15 into the debris guard tube 6 by hand. However, since the water in the drilling area is often not clear, a simple open guide on the side of the strut 1 may be used to assist the drill operator 14. The drill guide tube 24 as seen in the preferred embodiment of FIGS. 3, 4 and 5 is of particular use to the drill operator 22 in directing the long, 20 feet (6 m.) or more, explosives placement tubes 15 into the debris guard tube 6 and the hole 16 from the operator's platform 21.

The explosives placement tube 15 can be a PVC or polyethylene pipe which is large enough for a loose fit with the inside diameter of the drill hole 16.

METHOD OF OPERATION OF THE INVENTION

In a typical operation, a portion of the rock bottom of a body of water is to be broken up by explosives for subsequent removal of the rubble in order to lower the bottom. In preparing an area for blasting, a group of about 40 ten foot long (3 m.) holes may be drilled, loaded with sticks of dynamite and detonators, and then all 40 holes are blasted.

Each hole may be about 3½ inches (8.9 cm.) in diameter and penetrate the rock for about 10 feet (3 m.). Such a hole may be drilled in about 30 minutes. Drill placement time and setup time may be additional. About ten minutes are required to place the dynamite in the hole with the detonator and packing material which is usually sand.

The setup time and drill placement time for the operators using the preferred embodiment of my invention is minimal as a number of holes may be rapidly located from one position of the truck or tractor upon which the backhoe arm 19 is mounted. If the area to be blasted is within reach of the backhoe arm from the shore, the truck or tractor may be rapidly moved from one spot to the next to set up for the next series of holes. If the area is beyond reach of the backhoe arm from the shore, a similar operation may be executed from an anchored barge.

When the truck or tractor is in position for drilling, the backhoe operator lowers the rock drill strut 1 into the water until the debris guard tube 6 is forced agaisnt the rock at the desired position for drilling. The drill operator 22, standing on the control platform 21, energizes the drill actuator 5 to lower the drill head 13 in the guide tube 24 through the debris guard tube 6 into contact with the rock using the drill actuator 5 to advance the drill head 13 into the rock.

When the hole 16 has been drilled to the required depth, the drill operator 22 raises the drill motor 4 to the maximum height so as to facilitate the installation of the explosives placement tube 15. Then as seen in FIG. 5, he opens the guide tube door 25, pulls the drill rod 12 out of the guide tube 24, closes the door 25, and holds the drill rod 12 to one side with the rope 27. The drill operator 22 then inserts an explosives placement tube 15 into the hole 16 as seen in FIG. 4.

To be sure that the placement tube 15 will reach the required depth of hole, the drill operator can use the tube to find the depth of the water adjacent to the hole, mark the tube, and mark off an additional length equal to the required depth of hole in the rock so that when he inserts the placement tube 15 into the hole he can note the distance of this mark above the water mark on the tube, if any, and thus use the explosives placement tube 15 as a depth gauge, cleaning the hole repeatedly until the hole is clean to the required depth.

Although with my invention, the debris guard tube 6 is held firmly against the rock surface, there may be loose sand, cinders or gravel 30 between the rock layers through which the hole passes as seen in FIG. 4. Thus debris falling into the hole from such a layer, or layers, will require cleaning the hole several times before the placement tube 15 will reach the required depth. However when the placement tube 15 has been finally placed at the required depth, the placement of the explosives at that depth is assured.

When the explosives placement tube 15 has been finally located in the hole, the drill operator 22 signals the backhoe operator to carefully raise the rock drilling apparatus on strut 1 until the explosives placement tube 15 slips completely free of the debris guard tube 6. The backhoe operator then moves the rock drill apparatus into position for the drilling of the next hole. A third operator, positioned on a raft or small boat, loads hole by hole with dynamite, detonator and the packing material. The smooth inside wall of the placement tube 15 allows the charge to easily slide into the hole 16.

In this method, holes may be drilled several weeks ahead of loading and blasting. This separates the drilling from the loading operation, allowing the crew to load the 30 to 50 holes to be blasted at one time in a short period of time and then proceed with blasting. This reduces the length of time that the powder is in the hole before blasting, and thus makes blasting more effective. The separation of the two operations considerably reduces the operating time of the rock drilling machine and operator thus reducing the cost of the operation since both the machine and the operator have a high chargeout rate.

The loading tube protects the detonator wires and serves to show the location of the holes above water as seen in FIG. 4. The absence or presence of detonator wires at the top of the placement tube 15 indicates to the workers which holes have been loaded with explosives.

The importance of my construction of rock drilling apparatus and method of placing explosives can best be understood from a description of the drilling action. As the rock drill motor 4 imparts a combined hammer blow and turning action to the drill head 13 through the drill rod 12, air passing through the drill motor 4 and the central bore of the drill rod 12 and drill head 13 combines with the water in the hole 16 to pump debris out of the hole 16. The pressure of the air emerging from the drill head 13 and the flow of the air and water mixture is sufficient to loosen and flush out debris from the layers of loose material between layers of hard rock. As the debris emerges from the hole it mixes with the water surrounding the hole. Because of resulting turbulence and possible water currents, much of the debris would normally flow back into the hole were it not for the very positive seal obtained by forcing the debris guard tube 6 against the rock surrounding the hole by a force which can equal as much as one half of the weight of the backhoe or tractor drill instead of only the submerged weight of the debris guard tube 6 with or without the weight of the drill motor 4. Also since the debris guard tube is held against the rock surrounding the hole until the placement tube 15 has reached the required depth, the drill operator is assured that debris will not slip into the hole from above, nor from intervening layers of loose material. Use of my invention or apparatus and method of placing explosives in submerged rock thus speeds up the operation, reduces the amount of time that the expensive drilling apparatus and drill operator are charged to the job, insures the placing of the explosives at the required depth, allows a much greater flexibility in choice of blasting sequence and area, and increases the effectiveness of the explosives.

I claim:

1. Apparatus for placing explosives in submerged rock comprising:

a. a rock drilling apparatus having a power driven strut, the terminus of which can be forced against the surface to be drilled and a rock drill with the drill rod and drill head operably attached to the strut for extension of the drill head towards and beyond the terminus of the strut of the strut for drilling holes in rock;

b. a short debris guard tube operably attached in fixed position to the strut so as to extend beyond the terminus of the strut and so as to be coaxial with the drill whereby the strut can force the debris guard against the surface to be drilled to keep both surface debris and drillings out of the hole; and c. an explosives placement tube, the outside diameter of which is slightly less than the drill head and the length of which is greater than the combined depth of the hole to be drilled and the depth of the water at the surface to be drilled; whereby when the hole has been drilled and the drill has been retracted, the drill rod may be deflected and the explosives placement tube inserted into the hole through the debris guard tube with the debris guard tube held against the rock surface by the strut, and the debris guard tube retracted from the surface freeing the drilling apparatus from the explsoives placement tube, leaving the top of the explosives placement tube above the surface of the water.

2. Apparatus for placing explosives as claimed in claim 1, also comprising:

a. a drill guide tube open at both ends and at one side operably attached in fixed position to the strut above the debris guard tube so as to be co-axial with the drill; and b. a door operably attached to the drilling apparatus so as to allow closing of the side opening of the drill guide tube for guiding the drill head of explosives placement tube into the debris guard tube, or opening the side of the drill guide tube so that the drill rod may be deflected to one side of the drill guide tube when the drill is retracted so that the drill guide tube may serve to guide the explosives placement tube.

3. Apparatus for placing explosives as claimed in claim 2, wherein the drill guide tube and the debris guard tube are spaced apart sufficiently to allow debris to freely flow out of the debris guard tube into the surrounding water during drilling.

4. Apparatus for placing explosives as claimed in claim 1, also comprising attachment means operably attaching the power driven strut to the bucket end of a backhoe whereby the strut may be moved rapidly into position for drilling and the debris guard tube may be forced against the surface to be drilled with the strength of the backhoe.

5. A method of placing explosives in holes drilled in submerged rock by use of a rock drill mounted for reciprocation along a strut having a debris guard tube extending beyond the terminus of the strut comprising:

a. forcing the debris guard tube against the rock at the point to be drilled;
b. extending the drill head into the rock through the debris guard tube;
c. drilling and cleaning the hole with the drill;
d. retracting the drill out of the debris guard tube;
e. deflecting the drill rod to one side of the debris guard;
f. inserting an explosives placement tube into the hole through the debris guard tube;
g. raising the strut until the debris guard tube is completely free of the explosives placement tube whereby the drill operator can move to another location for drilling the next hole without waiting for completion of the explosives placement;
h. inserting the explosives and detonator into the hole through the explosives placement tube; and
i. stuffing packing into the tube; whereby the explosives placement tube being inserted into the hole through the debris guard tube keeps the hole clean and clear of debris after the drilling apparatus is removed thereby insuring placement of the explosives at the required point and allowing separation of drilling and explosives placement operations.

6. A method of placing explosives in holes drilled in submerged rock by use of a drill mounted for reciprocation along a strut having a drill guide tube surrounding the drill rod, said drill guide tube having a full length access door and said strut having a debris guard tube extending beyond the terminus of the strut comprising:

a. forcing the debris guard tube against the rock at the point to be drilled;
b. extending the drill head into the rock through the drill guide tube and the debris guard tube;
c. drilling and cleaning the hole with the drill;
d. retracting the drill out of the debris guard tube;
e. opening the drill guide door;
f. deflecting the drill rod to one side of the drill guide tube;
g. closing the drill guide tube door;
h. inserting an explosives placement tube into the hole through the drill guide tube and debris guard;
i. raising the strut until the debris guard tube is completely free of the explosives placement tube whereby the drill operator can move to another location for drilling the next hole without waiting for completion of the explosives placement;
j. inserting the explosives and detonator into the hole through the explosives placement tube; and
k. stuffing packing into the tube; whereby the explosives placement tube being inserted into the hole through the debris guard tube while against the rock keeps the hole clean and clear of debris after the drilling apparatus is removed thereby insuring placement of the explosives at the required depth in the rock and allowing separating the operations of drilling and explosives placement.

* * * * *

UNITED STATES PATENT AND TRADEMARK OFFICE

CERTIFICATE OF CORRECTION

PATENT NO. : 4,102,412

DATED : July 25, 1978

INVENTOR(S) : Roy N. Sonomura

It is certified that error appears in the above-identified patent and that said Letters Patent are hereby corrected as shown below:

Column 6, lines 67 and 68 and including all of Columns 7 and 8, cancel claims 5 and 6.

On the cover sheet below the Abstract, delete "6 Claims" and insert -- 4 Claims --.

Signed and Sealed this

*Thirteenth* Day of *February 1979*

[SEAL]

*Attest:*

RUTH C. MASON
*Attesting Officer*

DONALD W. BANNER
*Commissioner of Patents and Trademarks*